US005256953A

United States Patent [19]

Cimbal et al.

[11] Patent Number: 5,256,953

[45] Date of Patent: Oct. 26, 1993

[54] ELECTRICAL APPLIANCE WITH BATTERY CHARGING CAPABILITY AND CONNECTION MEANS

[75] Inventors: Jochen Cimbal, Friedberg; Horst Schinke, Kronberg/Ts.; Robert Jung, Friedberg, all of Fed. Rep. of Germany

[73] Assignee: Braun Aktiengesellschaft, Frankfurt, Fed. Rep. of Germany

[21] Appl. No.: 835,700

[22] Filed: Feb. 12, 1992

[30] Foreign Application Priority Data

Feb. 18, 1991 [DE] Fed. Rep. of Germany ..... 4104883

[51] Int. Cl.[5] ..... H01R 13/62

[52] U.S. Cl. ..... 320/2

[58] Field of Search ..... 320/2; 30/DIG. 1; 15/DIG. 1

[56] References Cited

U.S. PATENT DOCUMENTS

| | | | |
|---|---|---|---|
| 3,257,599 | 6/1966 | Somers et al. | 320/2 |
| 3,458,794 | 7/1969 | Bohnstedt et al. | 320/2 |
| 4,467,263 | 8/1984 | Conforti et al. | 320/2 |
| 4,743,829 | 5/1988 | Fenne et al. | 320/2 |
| 4,835,410 | 5/1989 | Bhagwat et al. | 320/2 |
| 5,030,902 | 7/1991 | Mattinger et al. | 320/2 |

FOREIGN PATENT DOCUMENTS

| | | |
|---|---|---|
| 3025159 | 7/1980 | Fed. Rep. of Germany . |
| 8504602.7 | 2/1985 | Fed. Rep. of Germany . |
| 3731724 | 9/1987 | Fed. Rep. of Germany . |
| 2186746 | 8/1987 | United Kingdom . |
| 2195938 | 6/1990 | United Kingdom . |

*Primary Examiner*—Steven L. Stephan
*Assistant Examiner*—Thomas M. Dougherty
*Attorney, Agent, or Firm*—Fish & Richardson

[57] ABSTRACT

The invention is directed to an electrical appliance comprising a housing for accommodating at least one functional component and at least one rechargeable storage cell adapted to be connected to the functional component, a storage cell charging circuitry, and an appliance plug provided on the electrical appliance and connected to the storage cell charging circuitry, the appliance plug having a receiving aperture for positive engagement with a mating connector for supplying a line voltage, the appliance further comprising latching elements provided on the appliance plug as well as on the detachable housing or housing portion.

27 Claims, 7 Drawing Sheets

35
6
21
37
7
38
39
33
36
31
30
32
29
20
40
16
42
41
15
34
27
28
25
46
26
24
44
23
45
48
22
43
50
51
19
47
49
17
18
60
53
54
59
58
61
55
56
57
2
11
9
10
12
13

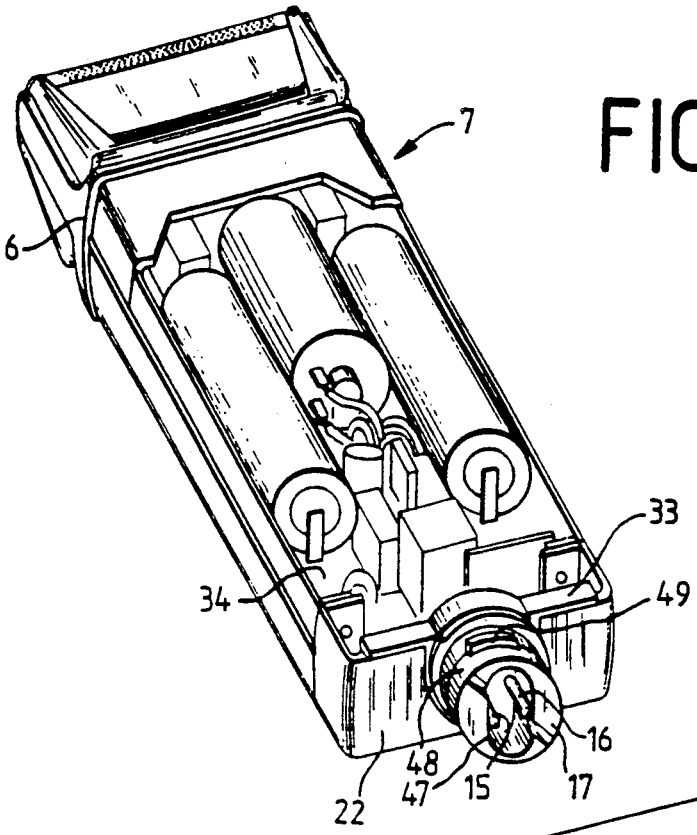
FIG.4
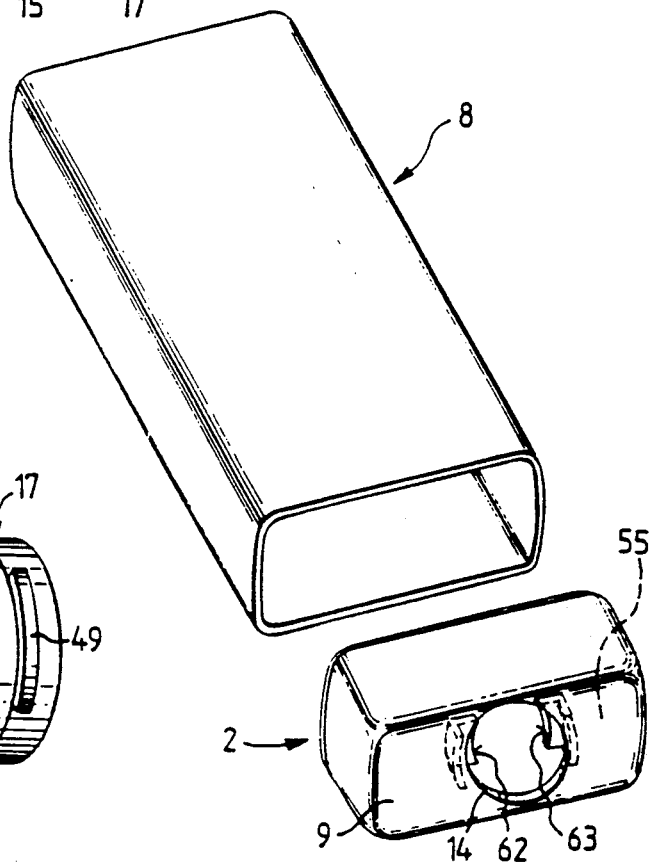
FIG.4a
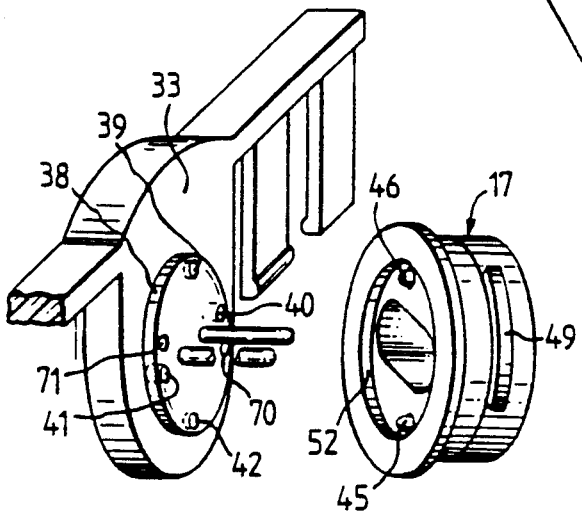

FIG.5
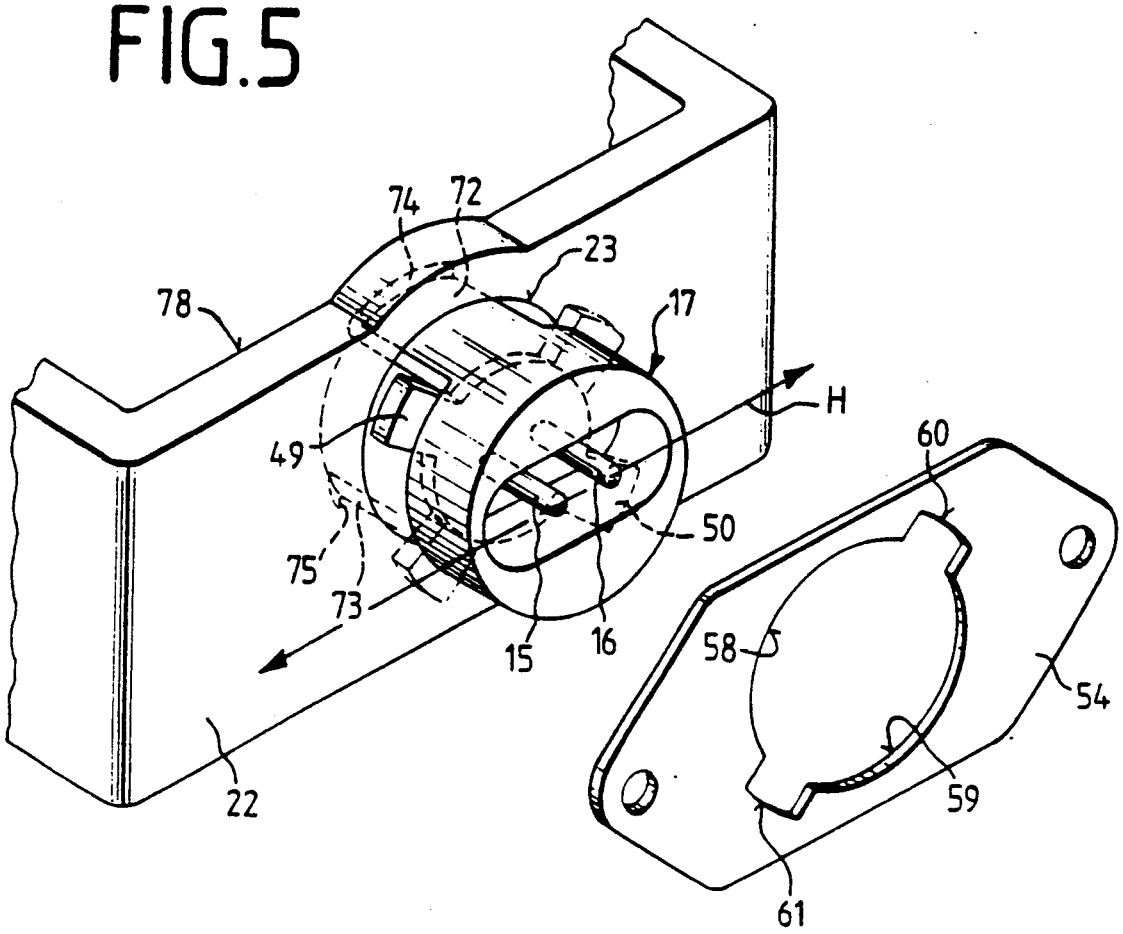
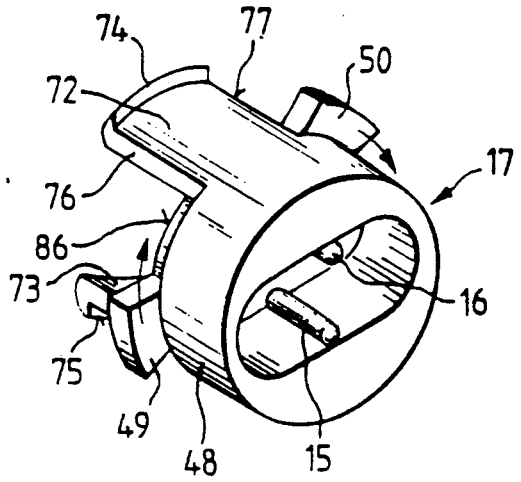
FIG.5a

ELECTRICAL APPLIANCE WITH BATTERY CHARGING CAPABILITY AND CONNECTION MEANS

This invention relates to an electrical appliance comprising a housing for accommodating at least one functional component and at least one rechargeable storage cell adapted to be connected to the functional component, a storage cell charging circuitry, and an appliance plug provided on the electrical appliance and connected to the storage cell charging circuitry, the appliance plug having a receiving aperture for positive engagement with a mating connector for supplying a line voltage Electrical appliances of this type operated by means of rechargeable storage cells including, for example, electric shavers, toothbrushes, screwdrivers, drills, flashlights, etc., are widely used in practice For recharging the storage cells, these electrical appliances are equipped with an appliance plug standardized for safety reasons, its receiving aperture being adapted to receive in positive engagement therewith an equally standardized connector of a power cord for supplying a line voltage. The utility of such electrical appliances is very high, because the storage cells can be recharged very frequently. After each charging operation, a fully functional electrical appliance is available which can then be used without being connected to a power cord. The storage cell charging circuitry of such electrical appliances frequently includes further electric components ensuring operation of the electrical appliance directly on the supply line, irrespective of the charging condition of the storage cells.

As is known, the useful life of rechargeable storage cells is limited Therefore, electrical appliances equipped with rechargeable storage cells should be constructed with a view to allowing safe removal of spent storage cells.

It is an object of the present invention to configure an electrical appliance of the type initially referred to in such a manner that the rechargeable storage cell(s) can be readily removed from the electrical appliance, without involving the risk for the operator to come in contact with the dangerous line voltage.

According to the present invention, this object is accomplished in an electrical appliance of the type referred to in the foregoing by modifying the spatial association of contact pins with a connector base surrounding the contact pins, with latching elements being provided which are in cooperative relation with a detachable housing or housing portion This solution of the invention affords several advantages. First, the electrical appliance can be opened very easily by the operator. The latching engagement existing between the connector base or the components carrying the contact pins and the housing or a housing portion detachable from the housing is disengageable using a rotating motion of the connector base or the component carrying the contact pins, as a result of which the housing or the housing portion detachable from the housing can be removed from the electrical appliance. The storage cell(s) provided is (are) then readily accessible for removal or replacement.

From the modification of the spatial association of connector base with contact pins as provided, there results a change of the position of the contact pins inside the receiving aperture of the connector base of the appliance plug. This position change of the contact pins allows a positive engagement connection between appliance plug and mating connector of a power cord for the supply of a line voltage only when a housing and/or a detachable housing portion is in locked condition with the connector base or the component carrying the contact pins, and prevents also a rotary motion of either the connector base or the component carrying the contact pins, when the connector of a power cord is coupled to the appliance plug. It is thereby ensured that the electrical appliance can only be opened when the connector is not coupled to the connector base of the appliance plug.

In a further embodiment of the invention, a particularly safe construction is characterized by the provision of cooperating detent means between a component carrying the contact pins and the connector base.

By this means it is ensured that, in the open condition of the electrical appliance, coupling of the connector of a power cord to the appliance plug cannot be accomplished because of the limited range of rotation of the connector base or the component carrying the contact pins by the detent means, in combination with the resulting position of the contact pins inside the receiving aperture of the appliance plug.

Accordingly, in an electrical appliance of the invention, any possibility for the operator to come in contact with the dangerous line voltage is necessarily eliminated.

In another embodiment of the invention, a component carrying the contact pins and the connector base of the appliance plug surrounding the contact pins are mounted so as to be relatively rotatable within limits, and the housing and/or a housing portion detachable from the housing is/are movable into and out of locking engagement with the connector base or the component carrying the contact pins using the limited rotatability.

In a suitable embodiment of the invention, the housing is comprised of a shell surrounding a housing frame and a detachable housing portion holding the shell against an abutment wall provided on the housing frame.

In a further embodiment of the invention, the housing is formed of a shell having a U-shaped cutout in one of the side walls of the shell and a detachable housing portion comprising a bottom member and an integral wall member for closing the U-shaped cutout.

In a preferred embodiment of the invention, the appliance plug is comprised of fixedly disposed contact pins and a surrounding connector base mounted so as to be rotatable within limits, and the housing or a housing portion detachable from the housing is adapted for locking engagement with, or disengagement from, the connector base rotatable within limits.

In a still further embodiment of the invention, the appliance plug is comprised of a fixedly disposed connector base and a disk mounted so as to be rotatable within limits in the connector base and carrying the contact pins, and the housing or a housing portion detachable from the housing is adapted for locking engagement with, or disengagement from, the disk rotatable within limits and carrying the contact pins.

Preferably, a bayonet joint couples the housing or the detachable housing portion to the connector base rotatable within limits or to the disk rotatable within limits and carrying the contact pins.

The solution of the invention is suitable for use with any type of electrical appliance operated with rechargeable storage cells, in which charging and operation can be performed by means of a connector attached to a plug-in power cord. A preferred application is a shaving apparatus equipped with rechargeable storage cells. An embodiment of the present invention will now be described in more detail in the following with reference to the accompanying drawings, in which.

Figure 3:
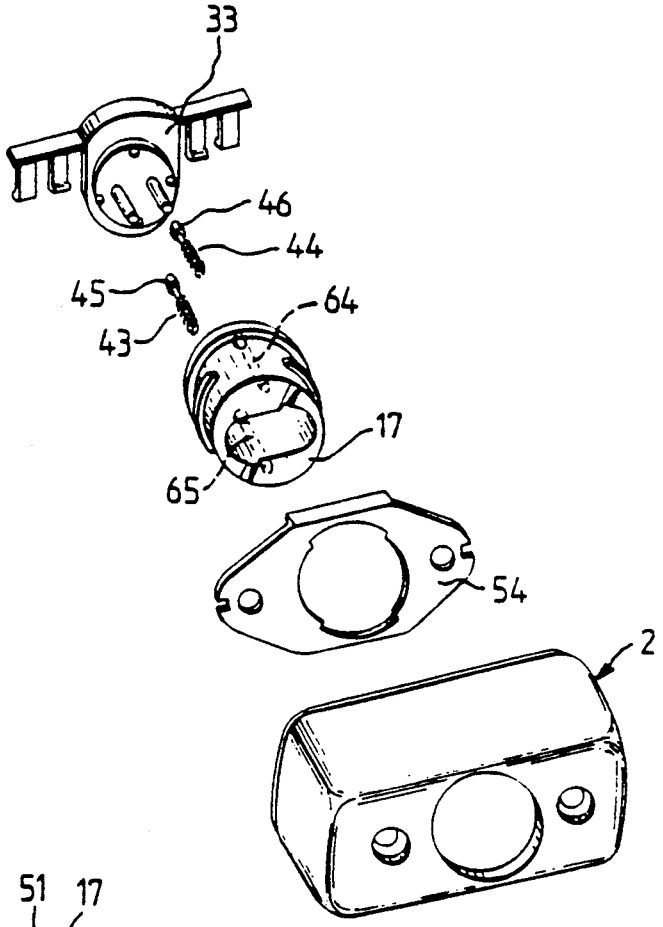
FIG. 3 is an exploded view of parts of the appliance plug as well as the housing portion.
Figure 3A:
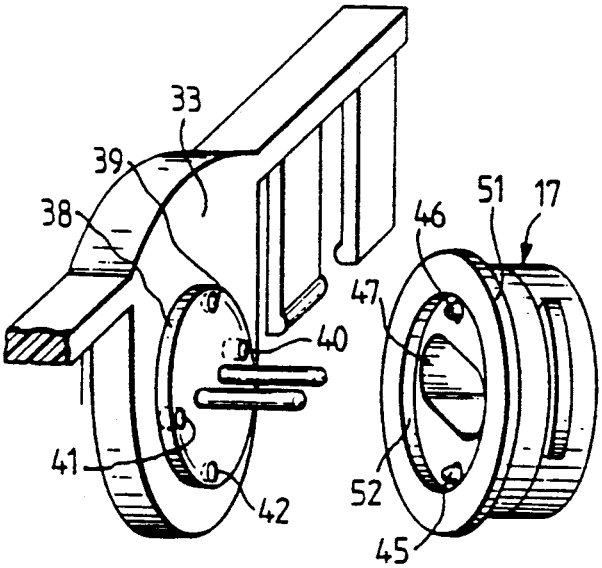
Figure 6:
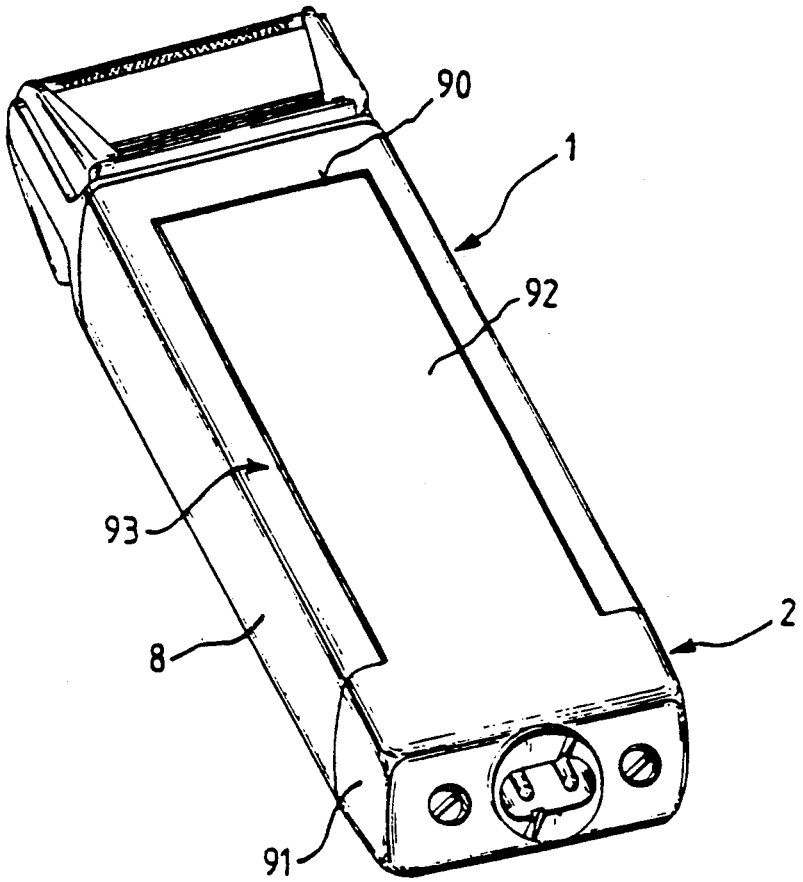

FIG. 3*a* is a perspective view of the plug mounting structure and the connector base;

FIG. 4 is an exploded view of a shaving apparatus in which the housing and the housing portion are removed;

FIG. 4*a* is a perspective view of the plug mounting structure and the connector base;

FIG. 5 is a view of a wall showing the appliance plug and a plate;

FIG. 5*a* is a detail view of the appliance plug of FIG. 5;

FIG. 6 is a perspective view of a shaving apparatus with a housing portion; and

Figure 7:
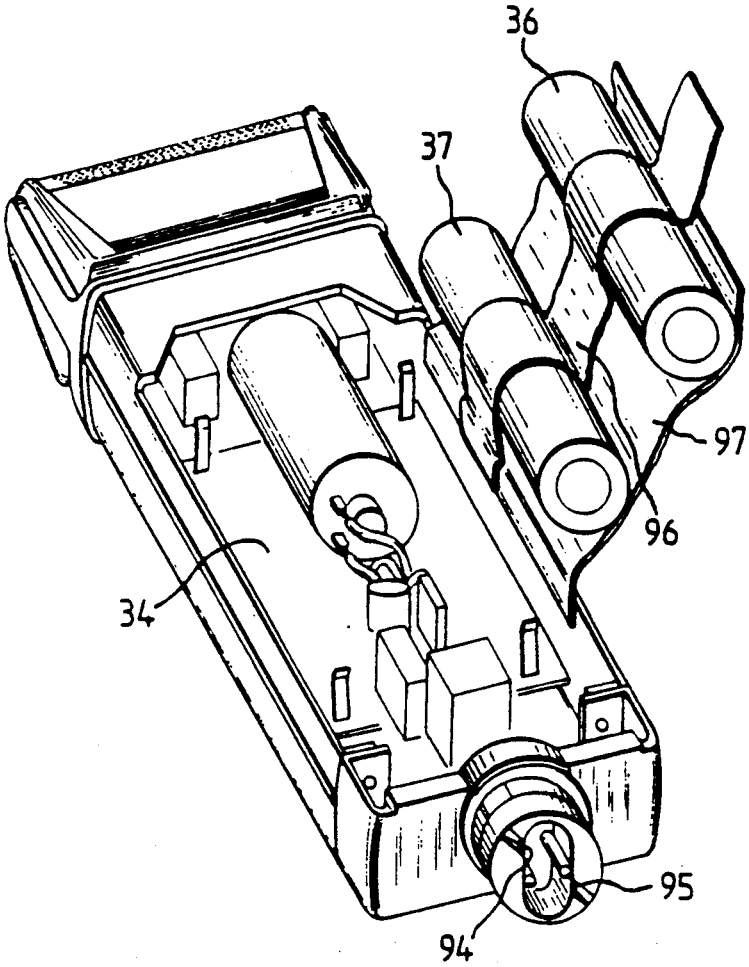

FIG. 7 is a view of an opened shaving apparatus with rechargeable storage cells.

Figure 1:
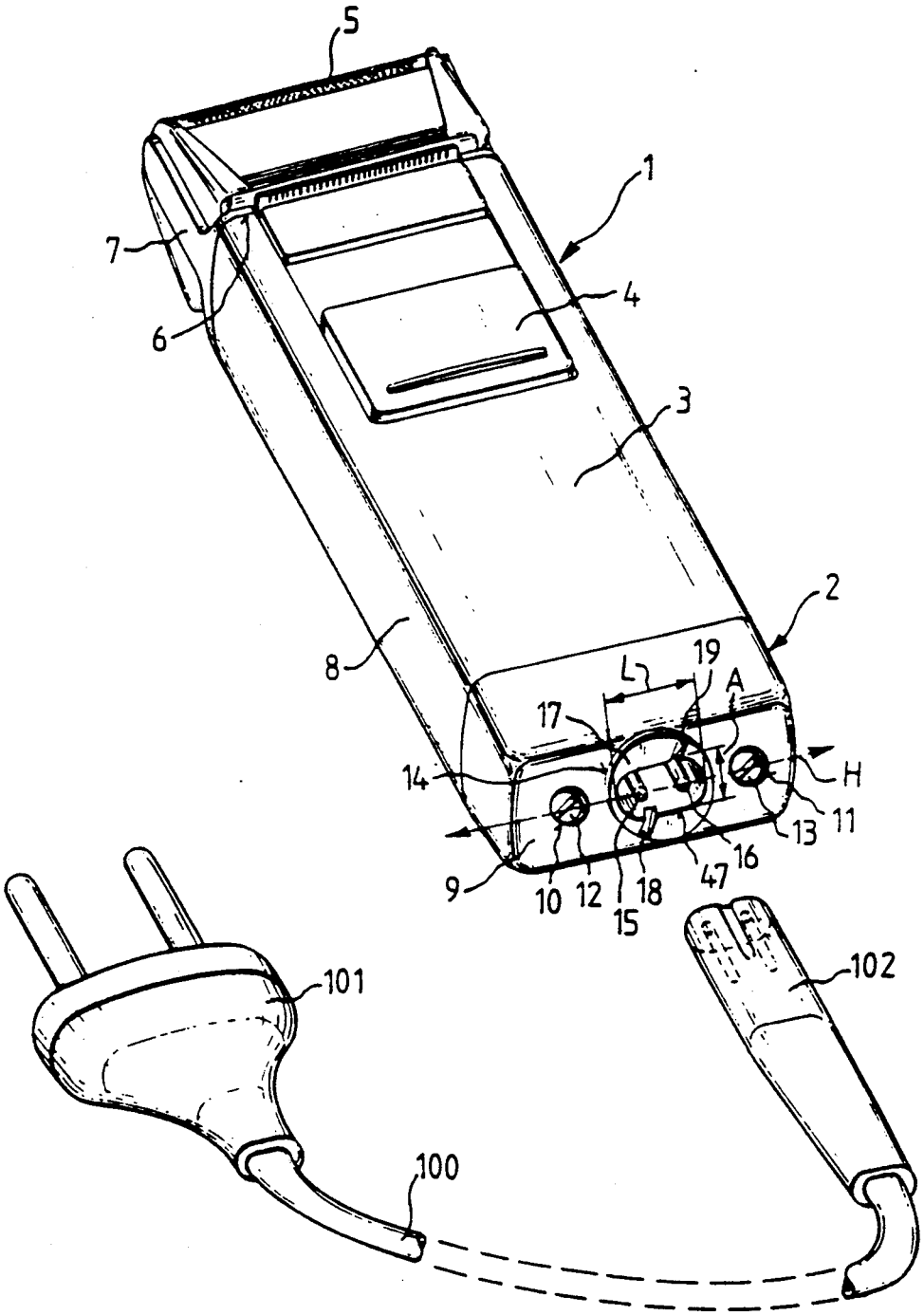
FIG. 1 is a perspective view of a shaving apparatus and an associated power cord.

Referring now to FIG. 1 of the drawings, there is shown an electrical appliance, for example, a dry shaving apparatus, comprising a housing 1 and a housing portion 2, an ON/OFF switch 4 slidably arranged on the front panel 3 of the housing 1 for energization of the electric drive received in the housing, and a shaving head 5 provided at the upper end of the housing.

The housing 1 is comprised of a shell 8 surrounding a housing frame 7 and a detachable housing portion 2 holding the shell 8 against an abutment wall 6 provided on the housing frame, the housing portion 2 being cup-shaped and conformed to the shape of the shell 8. Provided in the bottom wall 9 of the housing portion 2 are two round cutouts 10, 11 receiving screws 12, 13 therein, as well as a cylindrical opening 14 in which a connector base 17 surrounding two contact pins 15, 16 is arranged so as to protrude from the opening 14. Two slotted recesses formed in the forward end of the connector base are identified by reference numerals 18 and 19.

A power cord necessary for charging the storage cells or, alternatively, for operating the electrical appliance/shaving apparatus directly on the line is assigned reference numeral 100. The power cord 100 has at its one end a conventional attachment plug 101 and at its other end a connector 102 intended to be coupled to the electrical appliance. The connector 102 has its outer shape conformed to the contour of a receiving aperture 47 of the connector base 17, which aperture is determined by two planar side walls extending in the horizontal direction H and two round end walls interconnecting the side walls in vertical direction, with the relative distance A of the horizontal side walls being substantially smaller than the relative distance L of the round end walls. Provided in the receiving aperture 47 between the side walls extending in the horizontal direction H are two contact pins 15, 16 extending in a plane parallel to the side walls. In electrical appliances of this type including, for example, shavers, toothbrushes and the like, the relative distance of the contact pins plus the diameter of one of the contact pins corresponds approximately to the relative distance A of the horizontal side walls.

Figure 2:
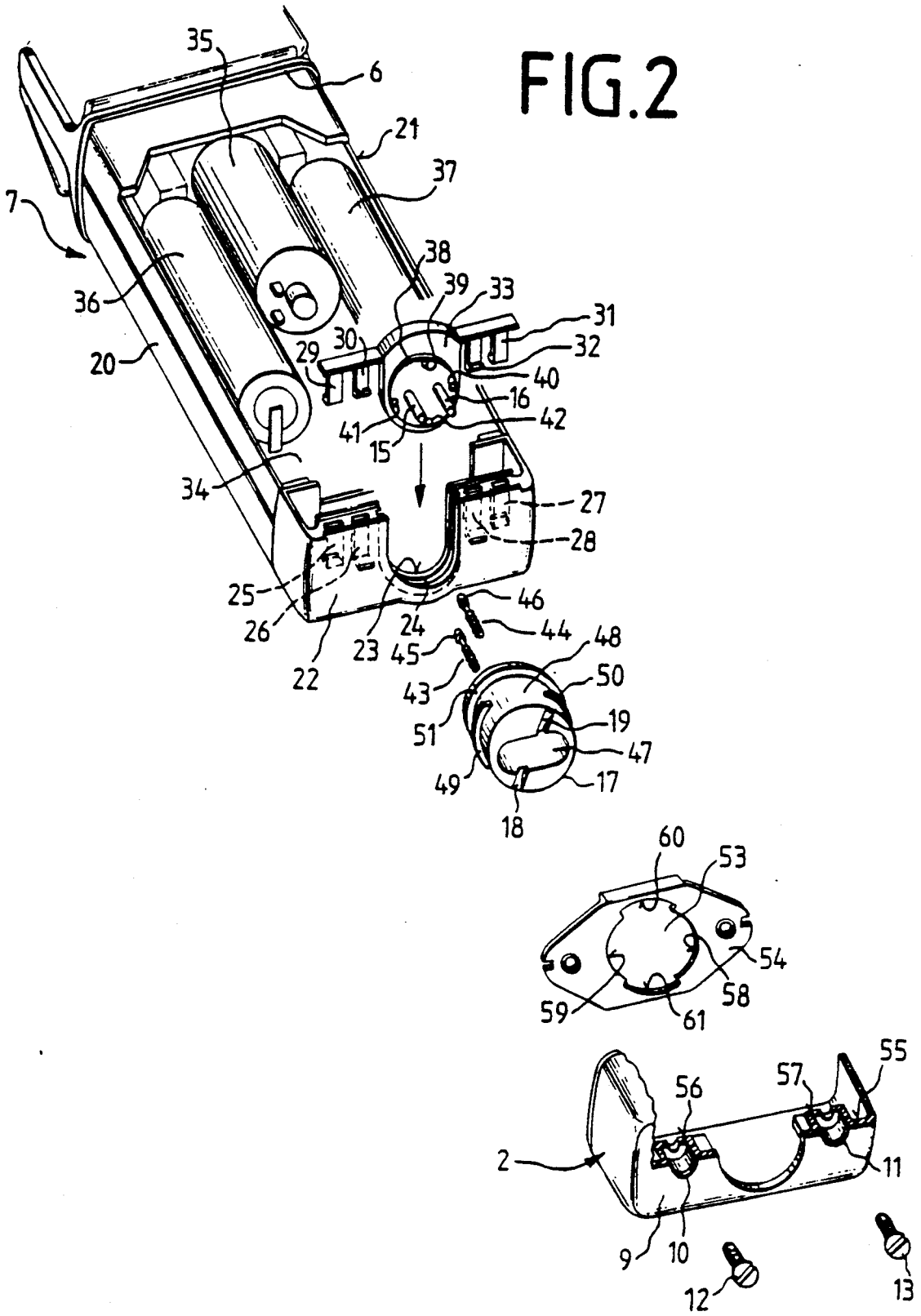
FIG. 2 is an exploded view of an opened shaving apparatus in which a housing portion is removed, showing also parts of the appliance plug.

The housing frame 7—see FIG. 2—is essentially comprised of two longitudinal end walls 20, 21 interconnected at the end remote from the abutment wall 6 by means of a wall 22. The end walls 20, 21 and the wall 22 enclose a printed circuit board 34 on which rechargeable storage cells 36, 37 and further electric components—see FIG. 4—of an electric circuitry are mounted, a respective cell being provided on either side of the functional component formed by the electric drive motor 35.

The wall 22 has a U-shaped cutout 23 in which a circumferential groove 24 is provided, as well as four insert openings 25, 26, 27, 28 for latching engagement with hooks 29, 30, 31, 32 of a plug mounting structure 33. Formed on the plug mounting structure 33 is a cylindrical step 38 with four integrally formed detent locations 39, 40, 41, 42 for engagement by tenons 45, 46 arranged in the rotary connector base 17 and movable against the pressure of springs 43, 44. The contact pins 15, 16 fixedly attached to the plug mounting structure 33 have their one ends in conducting relationship with the electric circuitry of the shaving apparatus, their other ends protruding into the receiving aperture 47 of the rotary connector base 17 intended to receive the connector 102 of the power cord 100.

The connector base 17 is of a cylindrical configuration having formed on its cylindrical outer surface 48 two diametrically arranged latching tabs 49, 50 and a circumferential annular shoulder 51. At its end close to the plug mounting structure 33, the connector base 17 is provided with a cylindrical recess 52 (see FIG. 3*a*) of a diameter conformed to the diameter of the cylindrical step 38 of the plug mounting structure 33, such as to ensure a perfect holding and guiding function on the cylindrical step 38 in the course of the rotary movement of the connector base 17. After the connector base 17 is seated on the cylindrical step 38 of the plug mounting structure 33, the two components are coupled to the wall 22 of the housing frame as an assembly. The latch hooks 29 to 32 are pushed into the respective insert openings 25 to 28 in the wall 22, and the annular shoulder 51 of the connector base 17 is seated inside the groove 24 in the U-shaped cutout 23 of the wall 22. With the parts locked in the desired position, the connector base 17 is rotatable relative to both the plug mounting structure 33 and the wall 22.

In the embodiment illustrated in FIG. 2, the detachable cup-shaped housing portion 2 is provided with a plate 54 having an opening 53 and secured by means of the screws 12, 13 to spacing means 56, 57 formed integrally on the inside 55 of the bottom wall 9 in diametrically opposite arrangement. The shape of the opening 53 in the plate 54 is produced by two diametrically opposite sectoral projections 58, 59 and two diametrically opposite sectoral cutouts 60, 61 separating the projections. The sectoral projections 58, 59 cooperate with the spacing means 56 and 57 to form two latching tabs when the plate 54 is fastened by the screws, whilst the sectoral cutouts 60 and 61 disposed in the plate 54 at a spacing of 90° relative to the projections are dimensioned and configured such as to enable the latching tabs 49 and 50 integrally formed on the connector base 17 to be passed through the cutouts 60 and 61.

With the connector base 17 and the plug mounting structure 33 in coupled condition with the wall 22, the horizontally extending side walls of the receiving aperture 47 are parallel with the front panel 3 of the housing 1, as illustrated in FIG. 1. With the connector base 17 oriented in this manner, the plate 54 is slipped over the latching tabs 49, 50 of the connector base 17 and moved into a position in which the latching tabs 49, 50 cooperate with the sectoral projections 58, 59 to assume a locked position. The housing portion 2 is subsequently fastened to the plate 54 by means of the screws 12, 13.

FIG. 3 shows an exploded view of plug mounting structure 33, tenons 45, 46 with springs 43, 44, connector base 17, plate 54 and housing portion 2. To receive the tenons 45, 46 and the springs 43, 44, two blind-end bores 64, 65 are provided in the connector base 17 in diametrically opposite arrangement. Further details of the configuration of plug mounting structure 33 and connector base 17 are illustrated in FIG. 3*a*. The plug mounting structure 33 includes a cylindrical step 38 serving a guiding and supporting function for the connector base 17 on which a cylindrical recess 52 mating with the step 38 is provided. In the assembled condition of plug mounting structure 33 and connector base 17, the contact pins 15, 16 attached to the plug mounting structure 33 on a plane in horizontal direction protrude into the receiving aperture 47 extending with its longitudinal extent equally in the horizontal direction. Integrally formed in the cylindrical step 38 are four detent locations 39 to 42 for receiving the two tenons 45, 46 spring-loaded in the connector base. The diametrically opposite detent locations 39 and 42 are of little depth, being dimensioned such as to ensure ready engagement and disengagement of the rounded ends of the tenons 45 and 46, whilst the diametrically opposite detent locations 40 and 41 are configured as blind-end bores of a depth preventing disengagement of the tenons 45, 46 after their locking engagement therein. In combination with the tenons 45, 46 lockingly engaged therein, the detent locations 40 and 41 thus serve as abutment stops for limiting the range of rotation of the rotary connector base 17.

As a result of the narrow, elongate shape of the receiving aperture 47 of the connector base 17 and the suitably adapted arrangement of the contact pins 15, 16 fixedly attached to the plug mounting structure 33 and the mating shape and configuration of the connector 102 of the power cord 100, the connector base 17 cannot be turned when the connector 102 is coupled to the connector base 17, accordingly preventing the detachable housing portion 2 from being removed from the housing 1. To be able to detach the housing portion 2 from the housing 1, it is necessary to pull the connector 102 of the electric power supply cord 100 from the connector base 17 of the electrical appliance. By subsequent turning of the connector base 17 using, for example, a coin inserted in the slotted recesses 18 and 19, the latching tabs 49, 50 located behind the sectoral projections 58, 59 can be disengaged from their locked position—see FIG. 4—and the housing portion 2 can be removed from the connector base 17. Then the shell 8 can be slipped off from the housing frame 7, thus exposing the storage cells 36, 37 for subsequent removal or replacement.

In the embodiment illustrated in FIG. 2, the range of rotation of the connector base 17 is limited by means of the detent locations 39 to 42 on the plug mounting structure 33 and the tenons 45 and 46 locking into the locations as well as by the configuration of the detent locations 39 to 42 illustrated and described with reference to FIGS. 3 and 3*a*. The range of rotation in clockwise or counterclockwise direction being 90°, the possibility of positive coupling engagement between the connector 102 and the connector base 17 is precluded when the connector base 17 is in unlocked position. Because in the unlocked position of the connector base 17 its tenons 45 and 46 are in locking engagement with the deeper detent locations 40 and 41, further rotation of the connector base 17 in clockwise or counterclockwise direction is reliably prevented also in cases where the housing portion 2 including the shell 8 are removed. In consequence, it is ensured that the connector 102 cannot be introduced in the connector base 17 when the electrical appliance is open, that is, following removal of the housing portion 2 and the shell 8. The possibility of a live connection between the electrical appliance and a convenience outlet is thus eliminated.

FIG. 4 shows the shaving apparatus of FIG. 2, the shell 8 and the housing portion 2 having been removed from the housing frame 7, as well as further electric components mounted on the printed circuit board 34. In the area of the cylindrical opening 14 in the bottom wall 9 of the housing portion 2, two hook-shaped latching tabs 62, 63 are integrally formed on the inside 55 in diametrically opposite arrangement. The latching tabs 62, 63 cooperate with the latching tabs 49, 50 provided on the cylindrical outer surface 48 of the connector base 17 to form a bayonet joint. As a result, the extent of the latching tabs 49, 50 in the circumferential direction is smaller than the circumferential extent of the sectoral cutouts formed by the latching tabs 62, 63. In FIG. 4, the receiving aperture 47 of the connector base 17 arranged to be rotatable relative to the plug mounting structure 33 and the wall 22 is shown as turned by an angle of 90° relative to the representation of FIG. 2, being thus in an unlocked position in respect of the latching tabs 62, 63 of the housing portion 2 relative to the latching tabs 49, 50, this position being determined by the spring-loaded tenons 45, 46 shown in FIG. 3*a* which are in locking engagement with the detent locations 40, 41. In this unlocked position, the housing portion 2 and the shell 8 can be detached from the housing frame 7 for removal of the exposed rechargeable storage cells, while on the other hand the connector 102 of the power cord 100 is prevented from being introduced in the receiving aperture 47 of the connector base 17.

In order to afford ease of assembly of the shell 8 and the housing portion 2 in the manufacture of the electrical appliance, further detent locations 70, 71 of reduced depth serving as assembly aids are provided ahead of the respective deep detent locations 40, 41 in the cylindrical step 38 of the plug mounting structure 33, as shown in FIG. 4*a*. In the assembly of the electrical appliance, the connector base 17 is seated on the cylindrical step 38 such that the ends of the tenons 45, 46 snap into the detent locations 70, 71. The plug mounting structure 33 and the connector base 17 are then coupled to the wall 22 as described with reference to FIG. 2, and the shell 8 is slipped onto the housing frame 7, and the housing portion 2 onto the connector base 17. The next step involves rotation of the connector base 17 in clockwise direction, causing the ends of the tenons 45, 46 to snap into the detent locations 39, 42. In the course of such rotary movement, the latching tabs 49, 50 engage the rear sides of the hook-shaped latching tabs 62, 63 of the housing portion 2, causing the housing portion 2 to be locked with the connector base 17 in the manner of a bayonet joint.

In a further embodiment not shown in the drawings, the shell 8 and the housing portion 2 shown in FIG. 4 may be combined to form an integral structure.

In the embodiment of FIGS. 5 and 5*a*, the contact pins 15, 16 are disposed in the connector base 17 secured in the wall 22 so as to be rotatable within limits. Integrally formed with the cylindrical connector base 17 in diametrically opposite arrangement are two ledge-type arms 72, 73 having latching tabs 74, 75 protruding relative to the cylindrical outer surface 48. On a disk 86 rotatably mounted in the connector base 17 are two diametrically opposite latching tabs 49, 50 configured to protrude relative to the cylindrical outer surface 48 and movable within the U-shaped cutouts 76, 77 in assembled condition of the connector base 17 and the disk 86, movement being limited by abutment with the respective arms 72 and 73.

In the embodiments illustrated in FIGS. 5 and 5*a*, the aperture angle of the respective U-shaped cutouts 76, 77 is dimensioned such as to ensure a rotary motion of the latching tabs 49, 50 between the arms 72, 73 in clockwise or counterclockwise direction by 90°. As a result, the contact pins 15, 16 fixedly attached to the disk 86 and extending through the disk to be coupled to the electric circuitry on the printed circuit board 34 or the rechargeable storage cells 36, 37—see FIG. 4—can be turned from the locked position shown in FIG. 5 to the unlocked position shown in FIG. 5*a*.

A cylindrical cutout 23 is provided in the wall 22 of the housing frame 7 or the housing of an electrical appliance. In the assembled condition of the disk 86 carrying the contact pins 15, 16 and the connector base 17, in which the latching tab 49 is in abutment with the arm 72 and the latching tab 50 is in abutment with the arm 73, the slightly resilient arms 72 and 73 are introduced in the cutout 23 and pushed in until the latching tabs 74, 75 are passed through the cutout 23 into abutment with the inside 78 of the wall 22, which is accomplished by a spring-back action of the arms 72, 73 slightly compressed during this process. With the latching tabs 49, 50 oriented as shown in FIG. 5, the connector base 17 firmly coupled to the wall 22 then receives the plate 54, which is accomplished by pushing the sectoral cutouts 60, 61 of the plate over the latching tabs 49, 50 into a position in which the latching tabs 49, 50 cooperate with the sectoral projections to assume a locked position. The next step involves fastening of the housing portion 2 to the plate 54 by means of the screws 12, 13—see FIG. 2. Turning the disk 86 using, for example, the contact pins 15, 16 causes the latching tab 49 to abut the arm 73 and the latching tab 50 to abut the arm 72—as shown in broken lines in FIG. 5 and as becomes also apparent from FIG. 5*a*. In this unlocked position, the housing portion 2 can be removed from the connector base 17 together with the plate 54. After the shell 8 is withdrawn, the storage cells 36, 37 as well as other electric components are freely accessible. In the unlocked position, the contact pins 15, 16 are in a position transverse to the horizontal direction H, in which a positive coupling engagement between the connector 102 and the connector base 17 is prevented from occurring. To prevent the contact pins 15, 16 from being returned to the locked position shown in FIG. 5 while a housing portion is removed, the locking device illustrated and described with reference to FIGS. 2, 3 and 3*a* is provided in the connector base 17 according to the embodiment of FIGS. 5, 5*a*, the locking device being comprised of the detent locations 39 to 42 on the rotatable disk 86 and the tenons 45, 46 loaded by the springs 43, 44.

In the embodiments illustrated and described with reference to FIGS. 1 to 5*a*, the contact pins and the connector base of the appliance plug surrounding them are mounted so as to permit relative rotation within limits, the range of rotation preferably covering an angle of 90°. By providing the relevant components with a suitable configuration, the range of rotation of these relatively rotatable components may be either below or above 90° in clockwise or counterclockwise direction.

Assuming that the contact pins are in the locked position and jointly rotatable as shown, for example, in FIG. 5, the respective permissible range of rotation is limited to slightly less than 180°. Limiting the range of rotation to 177°, for example, eliminates the possibility for the connector 102 of the power cord 100 to be in positive engagement with the connector base 17 and the contact pins 15, 16 while they are in their unlocked position.

FIG. 6 shows a dry shaving apparatus in which the housing 1 and the detachable housing portion 2, in a modification of the embodiment of FIG. 1, are conformed to each other. The housing 1 is comprised of a shell 8 attached to the appliance or the appliance frame and having a U-shaped cutout 90 in one of the sides of the shell 8 to expose the storage cells received in the housing, and comprising further a detachable housing portion 2 formed by a cup-shaped bottom member 91 and an integral wall member 92 for closing the U-shaped cutout. Preferably, the U-shaped cutout 90 in the shell 8 and the wall member 92 of the housing portion 2 covering the cutout are provided in the housing side panel 93 of the dry shaver opposite the front panel 3.

In a further embodiment, the slotted recesses 18, 19 provided in the forward end of the connector base 17 to enable it to be turned may be webbed as at 94, 95, as shown, for example, in FIG. 7.

FIG. 7 shows the dry shaving apparatus of FIG. 1 in open condition. A first foil ribbon 96 fastens the storage cells 36, 37 to a second foil ribbon 97 by means of an adhesive, paste, or by welding, the storage cells 36, 37 forming with the foil ribbons an assembly facilitating both the mounting of the storage cells 36, 37 in the manufacture of the appliance and their removal for disposal purposes. Removal of the assembly merely involves the step of pulling off the longer foil ribbon 96 from the printed circuit board 34. The spent storage cells 36, 37 can then be recirculated for further use or suitably disposed of.

We claim:

1. An electrical appliance comprising housing structure for accommodating at least one functional component and a compartment for at least one rechargeable storage cell adapted to be connected to said functional component, storage cell charging circuitry, appliance plug structure on said electrical appliance, said appliance plug structure having receiving aperture structure for positive engagement with a mating connector for supplying a line voltage, contact pin structure disposed in said receiving aperture structure and connected to said storage cell charging circuitry, a latching element carried by at least one of said contact pin structure and said receiving aperture structure, detachable housing structure, cooperating latch structure on said detachable housing structure for latching engagement with said latching element, said contact pin structure and said receiving aperture structure being relatively movable between a first position in which said mating connector can be electrically connected to said contact pin structure and said latching element and said cooperating latch structure are in latching engagement and a second position in which electrical interconnection of said mating connector and said contact pin structure is blocked and said latching element and said cooperating latch structure are released from latching engagement, said latch element and said latch structure being in latched relation when said contact pin structure and said receiving aperture structure are in said first position and in released relation when said contact pin structure and said receiving aperture structure are in said second position so that said detachable housing structure may be removed form said housing structure to allow access to said storage cell compartment.

2. The appliance of claim 1 and further including cooperating detent structure on said contact pin structure and said receiving aperture structure.

3. The appliance of claim 2 wherein said contact pin structure and said receiving aperture structure are mounted so as to be relatively rotatable within limits between said first position and said second position.

4. The appliance of claim 1 wherein said housing structure includes housing frame structure having an abutment wall, shell structure surrounding said housing frame structure and said detachable housing structure is adapted to hold said shell structure against said abutment wall.

5. The appliance of claim 1 wherein said housing structure includes shell structure with a U-shaped cutout and said detachable housing structure comprises a bottom member and an integral wall member for closing said U-shaped cutout.

6. The appliance of claim 1 wherein said contact pin structure is fixedly disposed on said housing structure and said receiving aperture structure is rotatable within limits between said first and second positions.

7. The appliance of claim 1 wherein said appliance plug structure includes a fixedly disposed base structure and said receiving aperture structure includes a disk portion mounted so as to be rotatable within limits in said base structure.

8. The appliance of claim 1 wherein said latch element and said latch structure include bayonet joint structure.

9. The appliance of claim 1 wherein said contact pin structure includes plug mounting structure carried in said housing structure.

10. The appliance of claim 9 wherein said housing structure includes a U-shaped cutout in said housing structure, and said plug mounting structure is detachably coupled to said cutout.

11. The appliance of claim 9 wherein said receiving aperture structure has a cylindrical outer surface, and includes two diametrically opposite latching tabs on said cylindrical outer surface.

12. The appliance of claim 1 wherein said detachable housing structure includes a cylindrical opening with two integrally formed hook-shaped latching tabs in diametrically opposite arrangement in said cylindrical opening.

13. The appliance of claim 1 wherein said detachable housing structure includes structure defining a cylindrical opening with integrally formed diametrically opposite spacing portions, and further including a plate with an opening, said opening having sectoral projections for cooperation with said spacing portions, and sectoral cutouts between said sectoral projections.

14. The appliance of claim 13 wherein said projections and said spacing portions cooperate to form latching tab structure.

15. The appliance of claim 1 and further including at least one spring-loaded tenon arranged in said appliance plug structure, and at least two detent locations in said contact pin structure for cooperation with said tenon to limit the relative motion of said contact pin structure and said receiving aperture structure.

16. The appliance of claim 15 wherein said detent locations are formed by abutment walls.

17. The appliance of claim 15 wherein said detent locations are formed by detent holes of different depths serving respective locking and unlocking functions.

18. The appliance of claim 15 wherein the range of relative movement of said receiving aperture structure and said contact pin structure is limited to less than 180° by the relative distance of said detent locations.

19. The appliance of claim 15 wherein the range of relative movement of said receiving aperture structure and said contact pin structure is limited to less than 90° by the relative distance of said detent locations.

20. The appliance of claim 1 wherein said receiving aperture structure has a forward end and two diametrically opposite slotted recesses are provided in said forward end.

21. The appliance of claim 20 and further including cooperating detent structure on said contact pin structure and said receiving aperture structure.

22. The appliance of claim 21 wherein said contact pin structure and said receiving aperture structure are mounted so as to be relatively rotatable within limits between said first position and said second position.

23. The appliance of claim 21 wherein said housing structure includes housing frame structure having an abutment wall, shell structure surrounding said housing frame structure and said detachable housing structure is adapted to hold said shell structure against said abutment wall.

24. The appliance of claim 23 wherein said contact pin structure is fixedly disposed on said housing structure and said receiving aperture structure is rotatable within limits between said first and second positions.

25. The appliance of claim 24 wherein said receiving aperture structure includes a wall of cylindrical configuration, said wall being provided with two diametrically opposite arms, and said contact pin structure is mounted in said receiving aperture structure and includes two radially extending latching tabs disposed for rotatably limited guidance between said arms.

26. The appliance of claim 25 wherein said detent structure includes at least one spring-loaded tenon arranged in said receiving aperture structure, and at least two detent locations in said contact pin structure for cooperation with said tenon to limit the relative motion of said contact pin structure and said receiving aperture structure.

27. The appliance of claim 1 wherein said compartment includes first and second foil ribbons for fastening said storage cell in said compartment.

* * * * *